United States Patent [19]

Kawabata et al.

[11] Patent Number: 4,471,608

[45] Date of Patent: Sep. 18, 1984

[54] OPEN-END SPINNING UNIT

[75] Inventors: Susumu Kawabata, Aichi; Tetsuzo Inoue, Nagoya; Tadanori Kurushima, Kariya; Kazuo Kamiya, Nishio, all of Japan

[73] Assignees: Kabushiki Kaisha Toyoda Jidoshokki Seisakusho; K.K. Toyota Chuo Kenkyusho, both of Aichi, Japan

[21] Appl. No.: 400,647

[22] Filed: Jul. 22, 1982

[30] Foreign Application Priority Data

Jul. 28, 1981 [JP] Japan ..... 56-117991

[51] Int. Cl.[3] ..... D01H 7/892

[52] U.S. Cl. ..... 57/413; 57/411; 57/415

[58] Field of Search ..... 57/408, 411, 415, 413

[56] References Cited

U.S. PATENT DOCUMENTS

| | | | |
|---|---|---|---|
| 3,538,698 | 11/1970 | Ripka et al. | 57/413 |
| 3,591,952 | 7/1971 | Ripka et al. | 57/413 |
| 3,624,994 | 12/1971 | Rohlena et al. | 57/415 X |
| 3,834,148 | 9/1974 | Sakurai et al. | 57/413 |
| 3,837,153 | 9/1974 | Didek et al. | 57/415 X |
| 3,908,349 | 9/1975 | Urifu et al. | 57/415 X |
| 3,952,494 | 4/1976 | Junek et al. | 57/415 X |

*Primary Examiner*—John Petrakes

*Attorney, Agent, or Firm*—Burgess, Ryan & Wayne

[57] ABSTRACT

A rotor type open-end spinning unit in which in order to prevent blowing of air to the rear of an outlet of a fiber transporting channel formed in a spinning body and impingement of an air stream from the fiber transporting channel against the back face of a separator, the rear end of the outlet of the fiber transporting channel on the central side of a rotor is expanded forward of an imaginary line, connected between the rear end of the channel outlet furthest from the center of the rotor and the center of the rotor, and the angle $\alpha$ between the face of the fiber transporting channel confronting the combing roller and the plane intersecting the axis of the rotor at a right angle is made substantially equal to the taper angle $\theta$ of the back face of the separator.

7 Claims, 18 Drawing Figures

OPEN-END SPINNING UNIT

BACKGROUND OF THE INVENTION

1. Field of the Invention

The present invention relates to an open-end spinning unit and particularly to a rotor-type open-end spinning unit in which a sliver is separated and opened by a combing roller mounted in a spinning body, opened fibers are fed into a rotor rotated at a high speed through a fiber transporting channel, and a spun yarn is taken out in succession from the rotor. More particularly, the present invention relates to a structure of a fiber transporting channel formed in a spinning body of an open-end spinning unit of the above-mentioned type.

2. Description of the Prior Art

In a conventional open-end spinning unit of the above-mentioned type, a separator is arranged so that opened fibers flowing into the rotor are not directly included in the yarn being twisted and the yarn is taken out from a guide hole formed at the center of the separator. In the conventional open-end spinning unit, the fibers are often wound on the separator, resulting in yarn breakage of formation of slubs in the yarn. The cause of this undesirable phenomenon has not been determined. Although various efforts have been made, it has hither to been impossible to eliminate this disadvantage.

SUMMARY OF THE INVENTION

The present invention conducted research to clarify the cause of the above-mentioned undesirable phenomenon. They found that it is caused by an abnormal air stream, described hereinafter, produced in the rotor. The present inventors thereupon conducted research to develope a measure for preventing this abnormal air stream, resulting in the present invention.

The present invention eliminates the above-mentioned defect involved in the conventional technique. It is a primary object of the present invention to provide a novel structure of a fiber transporting channel in an open-end spinning unit in which blowing of air to the rear of an outlet portion of the fiber transporting channel and impingement of an air stream against the back surface of a separator are eliminated, whereby winding of fibers on the separator and formation of slubs can be prevented.

The present invention will now be described in detail with reference to the accompanying drawings.

DETAILED DESCRIPTION OF THE INVENTION

Figure 1:
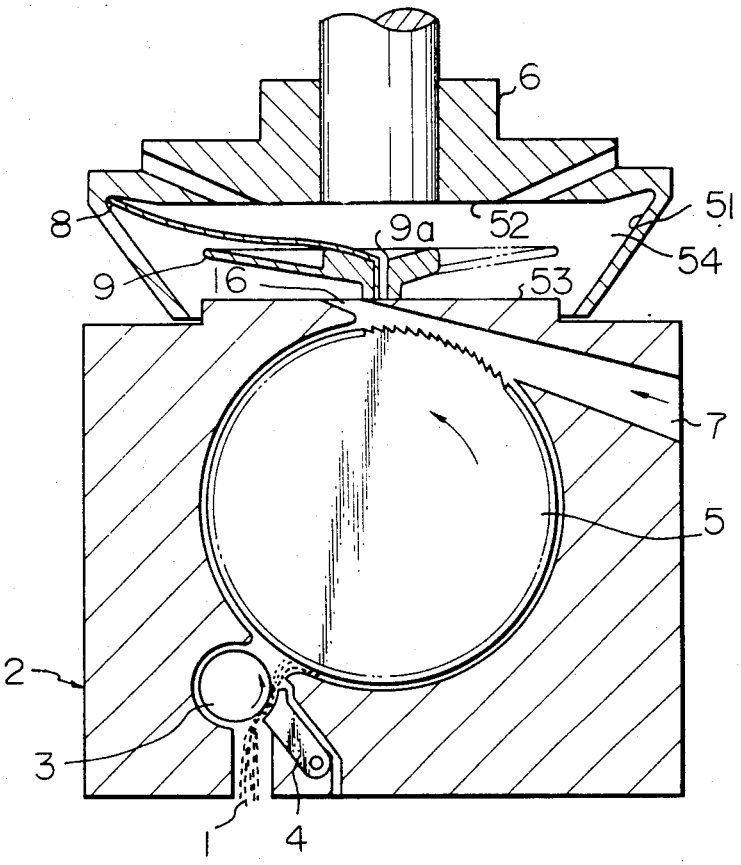
FIG. 1 is a sectional view illustrating a spinning zone in a rotor-type open-end spinning unit.

Ordinarily in a rotor-type open-end spinning unit, as shown in FIG. 1, a sliver feed mechanism comprising feed roller 3 and pressure 4 and combing roller 5 are arranged within spinning body 2. Rotor 6 is independently arranged.

Rotor 6 is engaged with driving means (not shown) so that rotor 6 can be rotated at a high speed. Rotor 6 has a cup-like shape defined by inner circumferential wall 51 and bottom wall 52. The portion confronting bottom wall 52 is opened. The intervening portion between walls 51 and 52 has the maximum inner diameter and forms fiber gathering surface 8. Rotor 6 is attached in such a manner that the opened portion of rotor 6 is substantially closed by projecting boss 53, which is a part of spinning body 2. Spinning chamber 54 is defined by boss 53, inner circumferential wall 51, and bottom wall 52.

Fiber transporting channel 7 is formed between combing roller 5 and spinning chamber 54 to pierce through spinning body 2. Fiber transporting channel 7 is opened on boss 53 to form outlet 16.

Separator 9, having a face inclined along the extension of channel 7, is secured to boss 53. Yarn guide hole **9*a* is formed at the center of separator 9**.

Sliver 1 is guided to combing roller 5 while being regulated between feed roller 3 and presser 4. It is then introduced into fiber transporting channel 7 while being separated and opened and is fed into spinning chamber 54 from outlet 16 carried on an air stream. Fibers transported in rotor 6 are accumulated in the form of a ribbon on gathering surface 8 of rotor 6 and are twisted. The resulting yarn is taken out from yarn guide hole **9*a* formed at the center of separator 9** and is wound on a bobbin (not shown).

As described hereinbefore, in the conventional rotor type open-end spinning unit, fibers are often wound on separator 9, causing operational trouble. Accordingly, the present inventors conducted to clarify the cause of this undesirable phenomenon.

Figure 2:
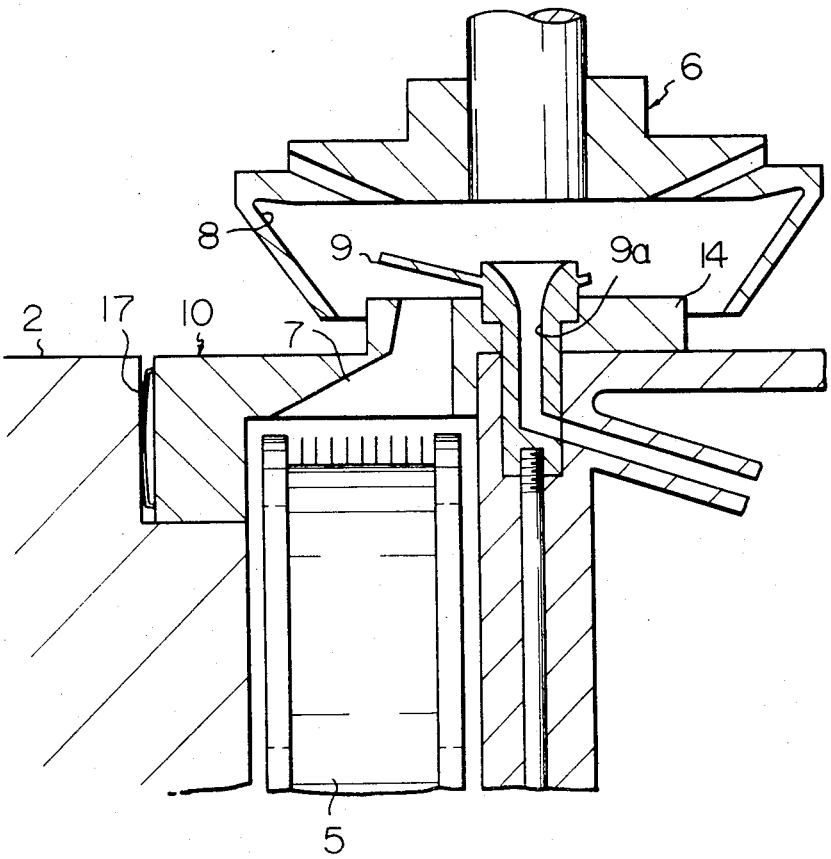
FIG. 2 is a sectional view illustrating a rotor type open-end spinning unit in which a part of a fiber transporting channel is formed independently from a spinning body.
Figure 3:
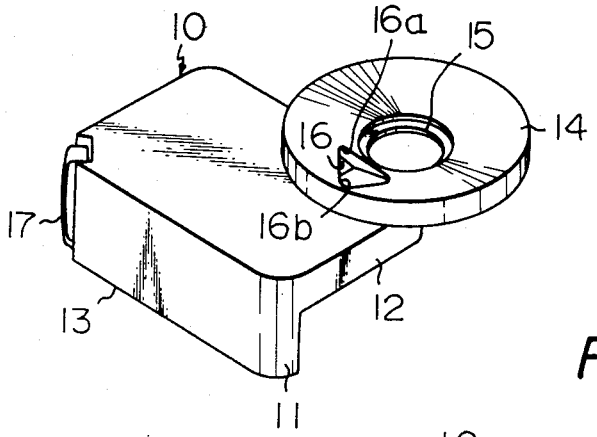
FIGS. 3 and 4 are perspective views illustrating a conventional member for forming a fiber transporting channel.
Figure 4:
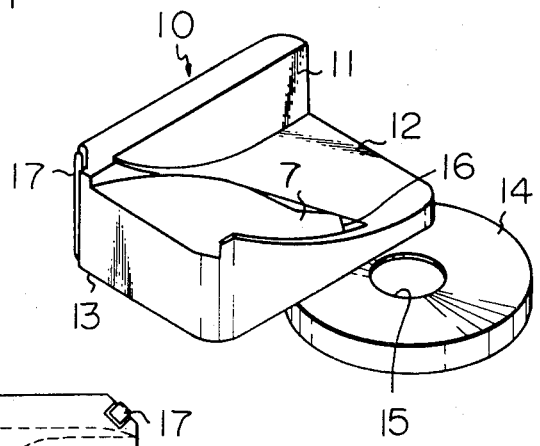
Figure 5:
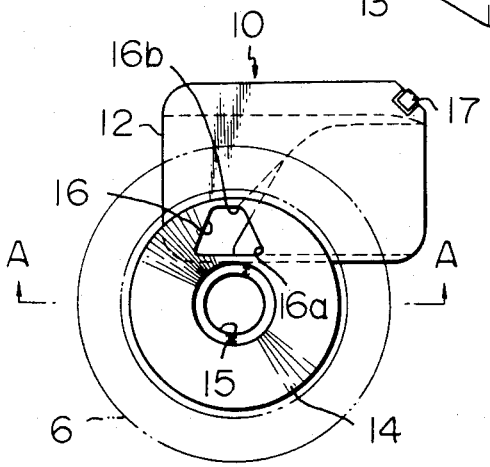
FIG. 5 is a plan view of the member illustrated in FIG. 3.
Figure 6:
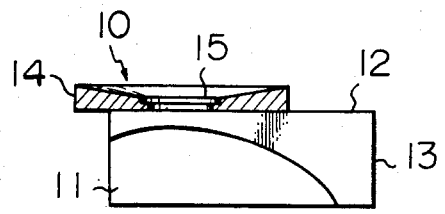
FIG. 6 is a view showing the section taken along the line A—A in FIG. 5.

The present invention replaced the rear portion of the fiber transporting channel behind combing roller 5 by fiber transporting channel forming member 10 independent from spinning body 2, as shown in FIG. 2. They examined air streams in rotor 6, especially in the vicinity of separator 9. As shown in FIGS. 3 and 4, fiber transporting channel forming member 10 which forms boss 53 in FIG. 1 comprises body portion 13 shaped to cover a part of the side face and the circumferential face of combing roller 5, respectively, with side wall 11 and top wall 12 thereof and comprises disc-like holding portion 14 integrally secureed to body portion 13. Hole 15 for insertion of separator 9 is formed at the center of separator holding portion 14. As shown in FIG. 6, the top face of separator holding portion 14 is dented at the center. Outlet 16 of fiber transporting channel 7 formed on top wall 12 is opened to separator holding portion 14. Fiber transporting channel forming member 10 is dismountably attached to spinning body 2 through spring 17 arranged on one end of side wall 11.

Figure 7:
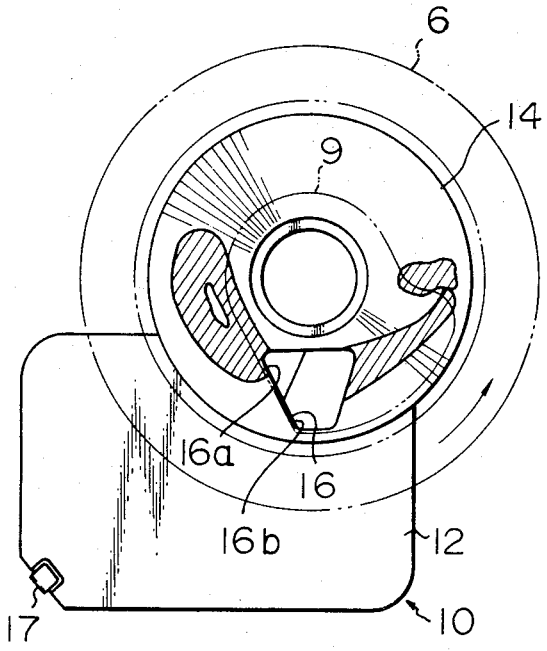
FIGS. 7 and 8 are plan views showing the results of a test conducted according to the visualization method in a conventional spinning unit.
Figure 8:
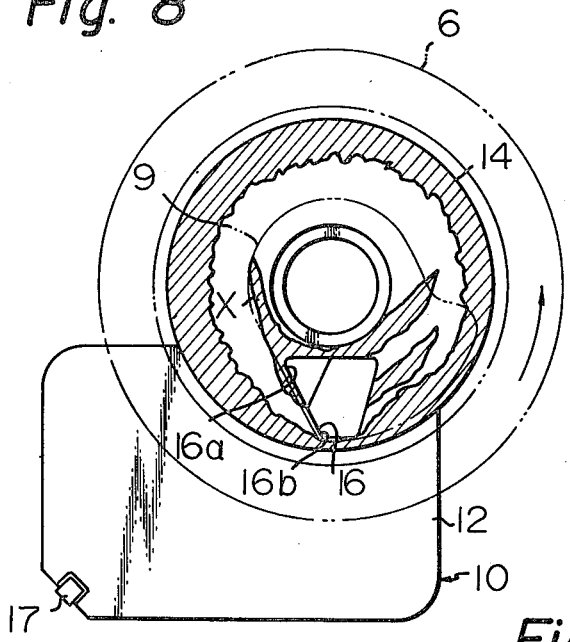
Figure 9:
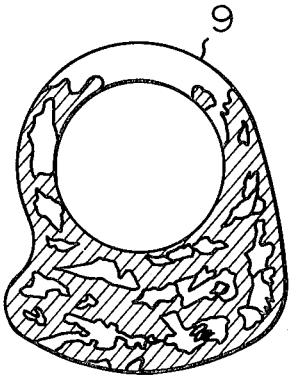
FIG. 9 is a back view showing a conventional separator.

As the method for checking the state of an air stream, there was adopted a method (visualization method) in which a paint formed by dissolving titanium oxide in an oil is coated on the inner wall of channel 7, the lower face of separator 9, or the top face of separator holding portion 14; idle running is carried out without feeding a sliver, and the state of the air stream is judged based on adhesion or peeling of the paint. Each experiment was carried out under the conditions of a 60,000 rpm rotational speed of rotor 6 and an 8,000 rpm rotational speed of combing roller 5. In FIG. 7, the results of the test where the paint was coated only on fiber transporting channel 7 are shown. The paint-adhering portion of the top face of the separator holding portion 14 is shown with hatched lines in FIG. 7. In FIGS. 8 and 9, there are shown the results of the tests where the top face of separator holding portion 14 and the back face of separator 9 were coated with the paint. The paint-peeled portions are shown with hatched lines in FIGS. 8 and 9.

As seen from FIG. 8, the paint was peeled from the peripheral edge of the top face of separator holding portion 14. This peeling was due to an accompanying air stream produced by rotation of rotor 6. Furthermore, there was formed paint-peeled portion X which extended from rear end 16*a* of channel outlet 16 nearest to the center of the rotor in the direction opposite to the rotation direction. This shows that air from fiber transporting channel 7 is strongly blown not only to the front of channel outlet 16 but also to the rear of channel outlet 16. This fact can be supported by the results of the test where the paint was coated only on the inner wall of fiber transporting channel 7. Namely, as shown in FIG. 7, at this test, the paint adhered and spread also in the direction opposite to the rotation direction from rear end 16*a* of channel outlet 16 nearest to the center of the rotor. Since the paint adhered and spread in the oval form, it is presumed that air blown from rear end 16*a* nearest to the center of the rotor toward the rear of channel outlet 16 was influenced by the accompanying air current produced by rotation of rotor 6 and was formed into swirls in the rear of channel outlet 16.

It is considered that the cause of the phenomenon of blowing of air to the rear of channel outlet 16 from outlet 16 was as follows.

Figure 10:
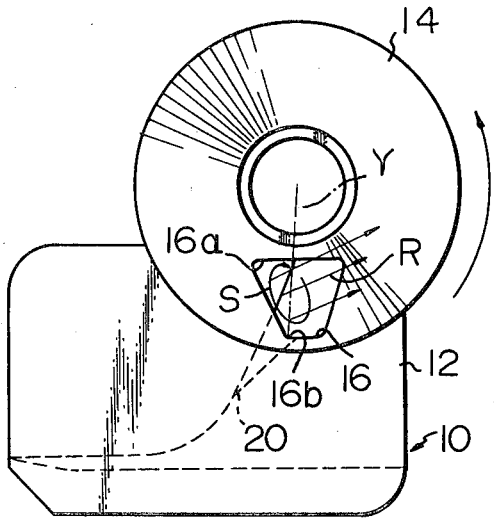
FIG. 10 is a plan view diagrammatically showing streams of air in a fiber transporting channel.
Figure 11:
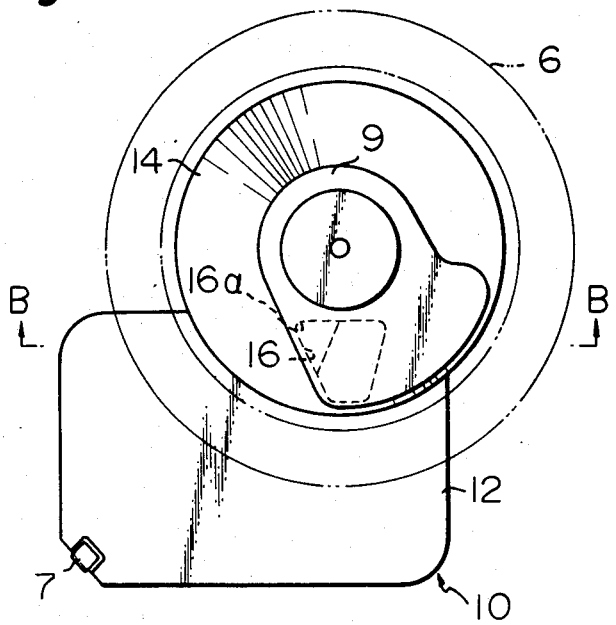
FIG. 11 is a plan view illustrating the relation between a separator and a member for forming a fiber transporting channel.

As shown in FIG. 10, in fiber transporting channel 7, there are present an air stream flowing along the channel, indicated by linear arrow R, and a circulating air stream, indicated by arrow S. In the case where rotor 6 is rotated in the counterclockwise direction in FIG. 10, the circulating stream is turned to the left toward channel outlet 16. The speed of this stream is high on the central side of the rotor and the pressure is low on the central side of the rotor. Since outlet 16 of conventional fiber transporting channel 7 is opened so that rear end 16*a* nearest to the center of the rotor is expanded backward of the imaginary line connected between rear end 16*b* furthest from the center of the rotor and the center of rotor 6, that is, in the direction opposite to the direction of the air stream, the above-mentioned circulating stream is blown from this expanded portion toward the rear of channel outlet 16.

Figure 12:
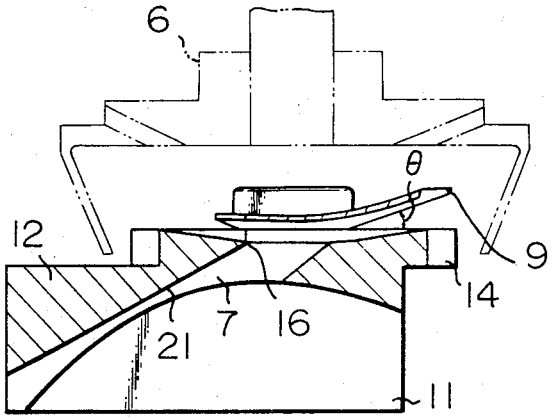
FIG. 12 is a view showing the section taken along the line B—B in FIG. 11.
Figure 13:
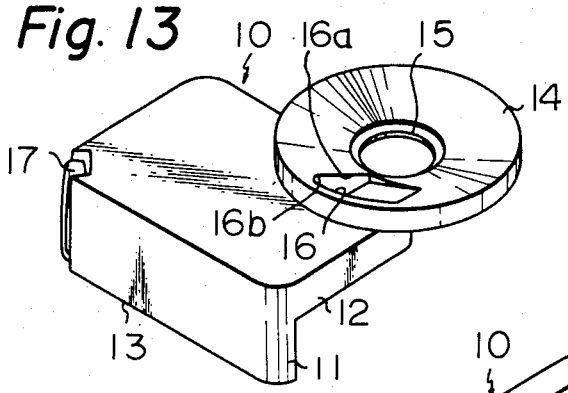
FIGS. 13 and 14 are perspective views illustrating a member for forming a fiber transporting channel according to an embodiment of the present invention.
Figure 14:
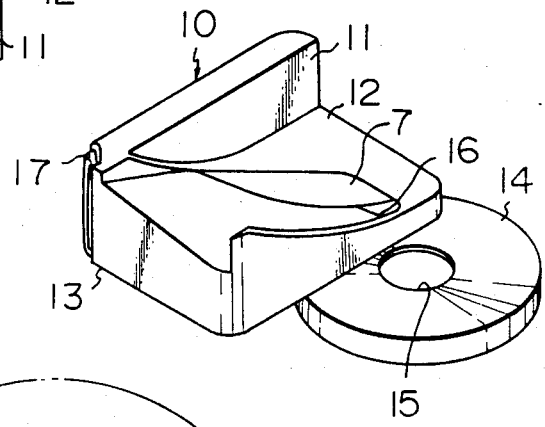

At the experiment where the paint was coated on the back face of separator 9, the majority of the coated paint was peeled as shown in FIG. 9. From this fact, it is seen that when the air stream from fiber transporting channel 7 flows into rotor 6, this air stream impinges strongly against the back face of separator 9. The reason why the air stream from fiber transporting channel 7 impinges strongly against the back face of separator 9 is considered to be that although the angle between the plane intersecting the axis of separator 9 at a right angle and the conical generating line defining the back face of separator 9, that is, taper angle $\theta$ of separator 9, is about 18°, conventional fiber transporting channel 7 is opened into rotor 6 at an angle larger than taper angle $\theta$, as shown in FIG. 12.

The present inventors completed the invention based on the foregoing findings. More specifically, in accordance with the present invention, there is provided an open-end spinning unit comprising a spinning body provided therein with a means for feeding a sliver and a combing roller, a rotor comprising a circular side wall, a botton wall, and an open space defined by both of said walls, where a spinning chamber is defined within said rotor in such a manner that a boss formed as a part of said spinning body covers said open space, and a fiber transporting channel having one side confronting said combing roller and an outlet opened to said spinning chamber and extending through said boss, said open-end spinning unit being characterized in that on the rear end line of said outlet of said fiber transporting channel, the portion nearest to the center of said rotor is positioned in a forward area exceeding an imaginary straight line between said center and a portion furthest to said center with respect to the rotational direction of said rotor.

An example of the present invention will now be described with reference to FIGS. 13 through 18.

Figure 15:
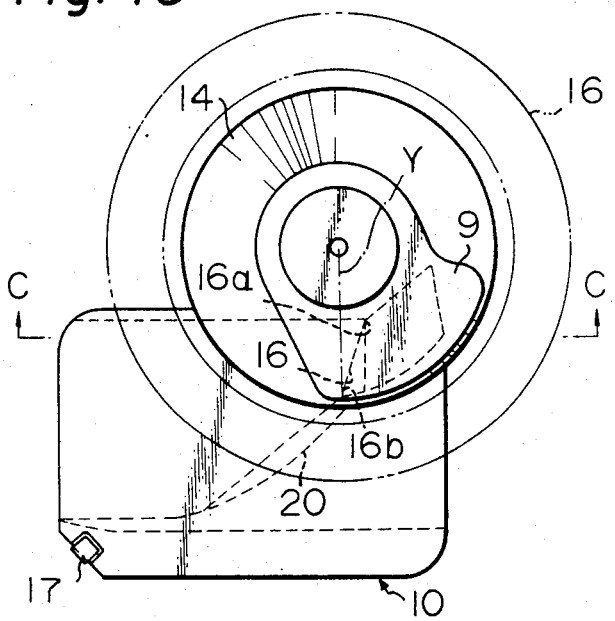
FIG. 15 is a plan view illustrating the relation between a separator and the member shown in FIGS. 13 and 14.
Figure 16:
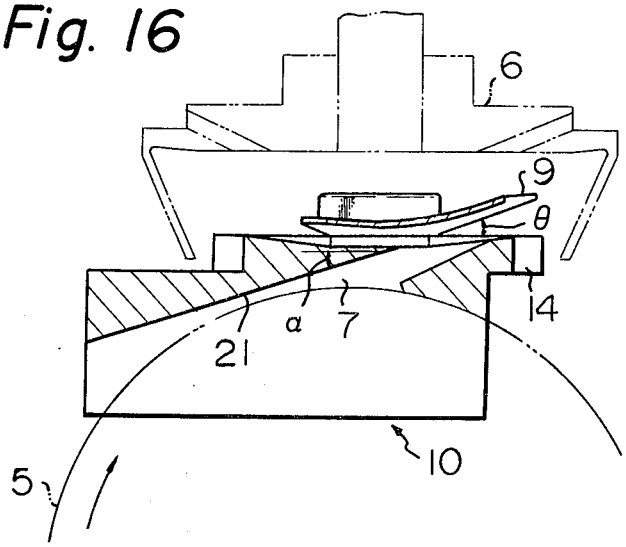
FIG. 16 is a view showing the section taken along the line C—C in FIG. 15.

In the present invention, at first, as shown in FIG. 15, rear end 16*a* of outlet 16 of fiber transporting channel 7 nearest to the center of the rotor is expanded forward of the imaginary line connected between rear end 16*b* furthest from the center of the rotor and the center of rotor 6, that is, in the flowing direction of air, and then, as shown in FIG. 16, angle $\alpha$ (hereinafter referred to as "front angle") between face 21 (front channel wall) of fiber transporting channel 7 confronting the peripheral face of combing roller 5 and the plane intersecting the axis of rotor 6 at a right angle is made substantially equal to the angle between the back face of separator 9 and the top face of the outermost end of separator holding portion 14, that is, taper angle $\theta$ of separator 9.

Figure 17:
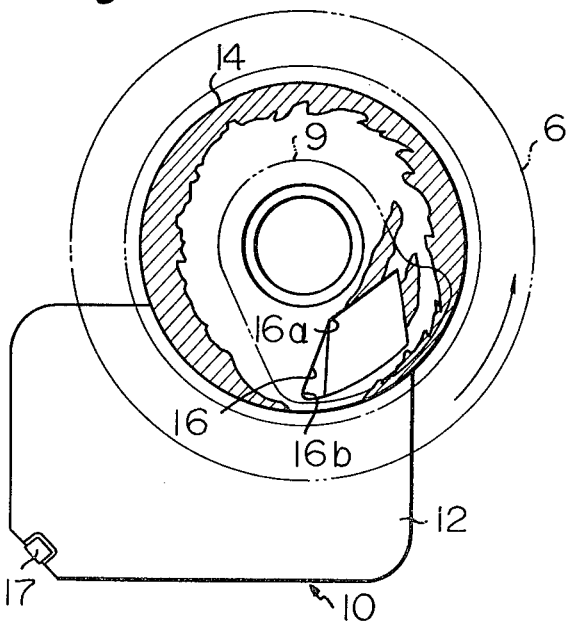
FIG. 17 is a plan view showing the results of a test conducted according to the visualization method in the spinning unit of the present invention.
Figure 18:
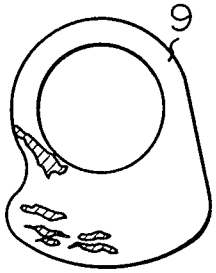
FIG. 18 is a back view showing a separator according to the present invention.

In fiber transporting channel 7 of the present invention having the above-mentioned structure, since rear end 16*a* of channel outlet 16 nearest to the center of the rotor is expanded in the flowing direction of air, the undesirable phenomenon observed in the conventional technique, that is, blow-out of a circulating air stream, one of the air streams is the channel, from rear end 16*a* of channel outlet 16 nearest to the center of the rotor toward the rear of outlet 16 is effectively prevented. Furthermore, since angle $\alpha$ of the front channel wall is substantially equal to taper angle $\theta$ of the separator, the stream of air blown from channel outlet 16 into rotor 6 flows along the back face of separator 9 and is prevented from impinging against separator 9. This is proven by the results of the experiment conducted under the conditions of 60,000 rpm rotational speed of rotor 6 and 8,000 rpm rotational speed of combing roller 5, shown in FIGS. 17 and 18. In FIG. 17, the portion where the paint coated on the top face of the separator holding portion was peeled is shown with hatched lines. The state of peeling of the paint on the peripheral edge of the top face of separator holding portion 14 by an accompanying air stream produced by rotation of rotor 6 and the state of peeling of the paint by blowing of air to the front of channel outlet 16 are substantially the same as those shown in FIG. 8. However, since peeling of the paint is not observed in the rear of channel outlet 16, it is apparent that blowing of air to the rear of outlet 16 does not occur. In FIG. 18, the portion where the paint coated on the back face of separator 9 was peeled is shown with hatched lines. Since the paint-peeled area is very small, it is apparent that the air stream from the fiber transporting channel does not substantially impinge against the back face of separator 9.

As is seen from FIG. 15, if the peripheral opening of channel outlet 16 is formed to extend substantially along the inclination angle of the channel bottom, the air stream can be introduced into rotor 6 even smoother. In the present invention, even if the shape of separator 9 is changed from the shape of the foregoing embodiment to a funnel-like shape covering the entire face of separator holding portion 14, the above-mentioned effects can similarly be attained. The present invention is not limited to the foregoing embodiment. Various changes and modifications can be made without departing from the scope of the present invention. For example, fiber transporting channel forming member 10 may be formed integrally with spinning body 2.

As will readily be understood from the foregoing description, according to the present invention, the rear end of the outlet of the fiber transporting channel nearest to the center of the rotor is expanded forward of the imaginary line connected between the rear end of the channel outlet furthest from the center of the rotor and the center of the rotor, and the angle of the front channel wall is made substantially equal to the taper angle of the separator. Due to these characteristic features, blow-out of air to the rear of the channel outlet and formation of swirls can be prevented and impingement of air against the back face of the separator can be prevented, whereby there can be attained an excellent effect of preventing winding of fibers on the separator and formation of slubs.

We claim:

1. An open-end spinning unit comprising a spinning body provided therein with a means for feeding a sliver and a combing roller, a rotor comprising a circular side wall, a bottom wall, and an open space defined by both of said walls, a boss formed as a part of said spinning body covers said open space to define a spinning chamber within said rotor, and a fiber transporting channel having walls, one of said walls confronting said combing roller and an outlet opened to said spinning chamber through the top surface of said boss opposite the bottom wall of said rotor and positioned between the center of the rotor and the sidewall thereof, said outlet having a substantially quadrangular shape and having a rear edge, with respect to the direction from which the fiber leaves the channel outlet, which extends from a position toward the center of the rotor to a position away from the center of the rotor wherein the portion of the rear edge of the fiber transporting channel outlet nearest to the center of said rotor is positioned in a forward area in front of an imaginary straight line between said center and the portion of the rear edge furthest from said center with respect to the rotational direction of said rotor and an edge nearer the center of the rotor and an edge nearer the sidewall of the rotor wherein the length of the edge of the outlet nearer the center of the rotor is shorter than the length of the edge of the outlet nearer to the sidewall of the rotor.

2. An open-end spinning unit according to claim 1 which further comprises, in said spinning chamber, a separator secured to said boss, said separator being provided with an extended portion having a surface which confronts said outlet, said surface being substantially parallel to the wall confronting said combing roller.

3. An open-end spinning unit according to claim 2 wherein a side edge of the opening of said outlet furthest from the center of the rotor extends along a side wall of said fiber transporting channel.

4. An open-end spinning unit according to claim 3, wherein said extending portion of said separator is confined in a space corresponding to the opening of said outlet.

5. An open-end spinning unit according to claim 3, wherein said extended portion of said separator is not confined in a space corresponding to the opening of said outlet.

6. An open-end spinning unit according to claim 2 wherein said surface of said separator makes an angle of about 18 degrees relative to a plane perpendicular to the axis of said rotor.

7. An open-end spinning unit according to claim 1, wherein the shape of said outlet is a quadrangle defined by a first pair of sides, one being disposed upstream of the other relative to the rotational direction of said rotor, each of which extends from a position toward the center of said rotor to a position away from the center of said rotor, and a second pair of sides each having different length, a shorter one being disposed nearer to the center of said rotor than a longer one, each of which extends substantially in the circumferential direction of said rotor, the mean length of said first pair being shorter than that of said second pair.

* * * * *